United States Patent [19]

Carr

[11] 4,338,275

[45] Jul. 6, 1982

[54] PROCESS FOR THE MANUFACTURE OF POLYESTER YARNS

[75] Inventor: Paul L. I. Carr, Harrogate, England

[73] Assignee: Imperial Chemical Industries Limited, London, England

[21] Appl. No.: 171,672

[22] Filed: Jul. 24, 1980

Related U.S. Application Data

[63] Continuation of Ser. No. 934,917, Aug. 18, 1978, abandoned.

[30] Foreign Application Priority Data

Aug. 19, 1977 [GB] United Kingdom ..... 34904/77

[51] Int. Cl.[3] ..... D01D 1/04

[52] U.S. Cl. ..... 264/176 F; 264/237

[58] Field of Search ..... 264/176 F, 237

[56] References Cited

U.S. PATENT DOCUMENTS

| | | | |
|---|---|---|---|
| 3,053,611 | 9/1962 | Griehl | 264/176 F |
| 3,361,859 | 1/1968 | Ceuzeto | 264/176 F |
| 3,946,100 | 3/1976 | Davis et al. | 264/176 F |
| 3,969,462 | 7/1976 | Stofan | 264/210.8 |
| 4,134,882 | 1/1979 | Frankfort et al. | 264/210.8 |
| 4,156,071 | 5/1979 | Knox | 264/210.8 |
| 4,255,377 | 3/1981 | Daumit et al. | 264/176 F |

FOREIGN PATENT DOCUMENTS

| | | | |
|---|---|---|---|
| 763339 | 7/1967 | Canada | 264/176 F |
| 48-1421 | 1/1973 | Japan | 264/176 F |

*Primary Examiner*—Jay H. Woo

*Attorney, Agent, or Firm*—Herbert M. Adrian, Jr.

[57] ABSTRACT

Manufacture of polyester yarns by a high speed draw spinning process in which the yarns are passed through defined fluid environments. Yarns are comparable in properties with conventional spin-lag-draw hot relax yarns.

5 Claims, No Drawings

PROCESS FOR THE MANUFACTURE OF POLYESTER YARNS

This is a continuation in part of Ser. No. 934,917 filed Aug. 18, 1978 and now abandoned.

The present invention relates to draw spinning processes for the manufacture of filamentary polyester yarns, and in particular to high speed single stage draw spinning processes for the manufacture of yarns which have properties comparable with those hitherto obtainable only by immediate speed single stage processes or two-stage spin-lag-draw/hot relax processes.

It has been proposed, for example according to UK patent specification No. 1,487,843, that multifilament polyester yarns may be advantageously formed by processes in which under certain defined conditions freshly extruded filaments are passed sequentially through solidification and conditioning zones and wound up at speeds between 1000 and 6000 meters/minute. In the practice of these processes, however, it has been found that yarn properties, especially yarn mechanical properties, begin to deteriorate as the wind-up speed is increased above about 5500 meters/minute. In particular the number of broken filaments occurring in the yarn increases until ultimately the yarn breaks, and in the case of low decitex filament yarns, where broken filaments are more likely to occur, this limitation has been found to be particularly serious.

In the present invention these deficiencies have been substantially overcome and it is now possible not only to maintain useful and desirable yarn properties up to wind up speeds of 6000 meters/minute, but to further increase wind up speeds and thereby spinning productivity without significant deterioration in yarn properties. High decitex filament yarns have derived especial benefit from this invention.

Accordingly, the present invention provides a draw spinning process for the manufacture of filamentary polyester yarns in which freshly extruded filaments are passed sequentially through a first fluid environment heated to a temperature above the melting point of the filaments and a second fluid environment heated to a temperature above the glass transition temperature of the filaments, and subsequently winding up the filaments at a speed in excess of 5500 meters/minute.

Preferably, the first fluid environment is heated to a temperature between the melting point of the filaments (in the range 260°-280° C.) and 350° C. (measured as described in Example 1) and the second fluid environment to a temperature between the glass transition temperature (in the range 80° C.-90° C.) and the melting point of the filaments. The two environments are separated from one another by a short distance, advantageously by between 100 cm and 500 cm. The distance selected is sufficient to cool the fibres below the temperature of the second fluid environment.

Desirably the fluid used is air, though nitrogen and steam may also be mentioned. Winding-up speeds are preferably in excess of 6000 meters/minute. Speeds above 8000 meters/minute are considered difficult to operate commercially and are not preferred.

The first heated fluid (air) environment through which the filaments are passed may be conveniently defined by means of an electrically heated vertically disposed cylindrical metal shroud of sufficient diameter to accommodate the travelling filaments, one end of which is sealed to the spinneret face. The length of the shroud is not critical and may be up to 100 cm, though shorter length shrouds are preferred. The second heated fluid (air) environment through which the filaments pass may conveniently take the form of an electrically heated elongate tube of circular cross-section which is mounted vertically between the shroud and the wind up means. The diameter of the tube should be sufficient to accommodate the travelling filaments and may be from 30 cm to 3 meters in length. Preferably the length of the tube is about 1 meter. Air in the tube may remain static but for turbulence caused by the moving filaments or heated air may be deliberately introduced into the tube (usually from a point at the downstream end thereof). Effective treatment tube temperatures (mean wall temperatures) have been found in the range 190° C. to 210° C.

By way of illustration only of the present invention the following examples are provided:

EXAMPLE 1 (According to the invention)

A 56 dtex 20 filament yarn was spun from polyethylene terephthalate polymer through a 20 hole spinneret with 0.009 inch diameter orifices. The pack (extrusion) temperature was 290° C. The intrinsic viscosity of the filaments was 0.62. Beneath the spinneret (point of extrusion) and sealed to it was a 30 cm long electrically heated cylindrical metal shroud with an internal diameter of 10 cm. The mean air temperature within the shroud, measured by thermocouples placed 2 cm from the inside wall, was 300° C. An electrically heated elongate static air tube of circular cross-section, 1 meter in length and 5 cm in diameter was mounted vertically below the hot shroud and approximately 2 meters below the spinneret. The mean wall temperature of the tube (measured by thermocouples) was 200° C. A pair of cylindrical guides were mounted at the yarn entrance to the tube to converge and ribbon the filaments, and minimise cold air entrainment. Yarn tensioning guides, as such, were absent. The yarn was wound up after a lubricating finish had been applied at various speeds between 4000 and 7500 meters/minute and the following yarn properties were obtained. These illustrate the effect of the invention as the wind-up speed is raised to 5500 meters/minute and above, ie no significant deterioration in yarn properties occurs as the wind up speed is increased to 7500 meters/minute. In particular the boiling water shrinkage remains very low thus obviating the need for further heat setting, while the high $TE^{\frac{1}{2}}$ values that are maintained reflect the good runnability of the process, ie a minimum number of broken filaments.

| WIND UP SPEED M/MIN | TENACITY (T) GM/DTEX | EXTENSION (E) % | BOILING WATER SHRINKAGE % | $TE^{\frac{1}{2}}$ |
|---|---|---|---|---|
| 4000 | 3.36 | 54 | 59.7 | 24.7 |
| 4500 | 3.63 | 37 | 9.9 | 24.9 |
| 5000 | 3.88 | 42 | 5.9 | 25.1 |
| 5500 | 4.23 | 34 | 5.6 | 24.5 |
| 6000 | 3.96 | 43 | 5.7 | 26.0 |
| 6500 | 3.82 | 40 | 4.9 | 24.1 |
| 7000 | 3.97 | 38 | 4.1 | 24.5 |
| 7500 | 3.87 | 46 | 4.4 | 26.2 |

EXAMPLE 2 (According to the invention)

Example 1 was repeated except that a 100 dtex 20 filament yarn was spun from polyethylene terephthalate polymer. Corresponding results illustrating similar effects are reported in the Table below:

| WIND-UP SPEED M/MIN | TENACITY (T) GM/DTEX | EXTENSION (E) % | BOILING WATER SHRINKAGE % | $TE^{\frac{1}{2}}$ |
|---|---|---|---|---|
| 4000 | 2.47 | 58.6 | 57.2 | 18.9 |
| 4500 | 2.79 | 62.2 | 31.1 | 21.9 |
| 5000 | 3.52 | 56.4 | 6.1 | 26.4 |
| 5500 | 3.53 | 53.6 | 5.6 | 25.8 |
| 6000 | 3.61 | 51.0 | 3.85 | 25.8 |
| 6500 | 3.67 | 45.8 | 3.6 | 24.9 |
| 7000 | 3.93 | 42.0 | 4.0 | 25.5 |
| 7500 | 4.2 | 41.6 | 3.4 | 27.1 |

EXAMPLE 3 (According to the invention)

Example 1 was repeated except that the heated shroud beneath the spinneret had a length of 60 cm and the mean air temperature therein (measured as in Example 1) was 200° C. Corresponding results were as follows:

| WIND-UP SPEED M/MIN | TENACITY (T) GM/DTEX | EXTENSION (E) % | BOILING WATER SHRINKAGE % | $TE^{\frac{1}{2}}$ |
|---|---|---|---|---|
| 4000 | 3.21 | 53.4 | 6.0 | 23.4 |
| 4500 | 3.26 | 39.2 | 6.6 | 20.4 |
| 5000 | 3.67 | 39.4 | 5.7 | 23.0 |
| 5500 | 3.82 | 30.8 | 5.7 | 21.2 |
| 6000 | 3.46 | 40.0 | 6.1 | 21.9 |
| 6500 | 3.47 | 35.6 | 5.8 | 20.7 |
| 7000 | Yarn breaks | | | |

As the results indicate a shorter, higher temperature shroud (Example 1) is preferred, though the results do demonstrate an improvement over the use of a heated tube on its own (Example 7). Nevertheless, yarn properties do begin to deteriorate slowly above a wind up speed of 5500 meters/minute and the yarn breaks above 6500 meters/minute, while 7500 meters/minute is possible according to Example 1.

EXAMPLE 4 (According to the invention)

Example 1 was repeated at a wind up speed of 6000 meters/minute while a number of different tube wall temperatures were investigated.
Results were as follows:

| TUBE TEMPERATURE °C. | TENACITY (T) GM/DTEX | EXTENSION (E) % | BOILING WATER SHRINKAGE % | $TE^{\frac{1}{2}}$ |
|---|---|---|---|---|
| 200 | 3.8 | 41.6 | 5.2 | 24.5 |
| 220 | 3.9 | 46.2 | 5.2 | 26.5 |
| 240 | 3.95 | 45.5 | 6.2 | 26.6 |
| 260 | 4.1 | 44.2 | 6.2 | 27.2 |

These results show that a small but significant improvement in tenacity is achieved by increasing the temperature of the tube. However, at temperatures of 260° C. and above yarn string-up becomes increasingly difficult and process runnability deteriorates.

EXAMPLE 5 (two stage spin-lag-draw/hot relax prior art process)

A 644 dtex 36 filament yarn was spun from polyethylene terephthalate polymer of intrinsic viscosity (IV) 0.675 through a 36 hole spinneret with 0.012 inch diameter orifices. The pack temperature was 289° C. The undrawn yarn was wound up at 1000 meters/minute and the filament IV was 0.63.

In a separate drawing process the yarn was hot drawn 4.6 times to give a 140 dtex yarn and sequentially hot relaxed 5.6%. The feed roll was heated to a temperature of 77° C. and the draw roll to a temperature of 220° C. The final wind-up speed was 550 meters/minute.

The yarn had the following properties:

| TENACITY (T) GM/DTEX | EXTENSION (E) % | BOILING WATER SHRINKAGE % | $TE^{\frac{1}{2}}$ |
|---|---|---|---|
| 6.75 | 17.0 | 3.0 | 27.8 |

EXAMPLE 6 (Single-stage process derived from the prior art)

A 56 dtex, 20 filament yarn was spun from polyethylene terephthalate through a 20 hole spinneret with 0.015 inch diameter orifices. The pack (extrusion) temperature was 295° C. The intrinsic viscosity of the filaments was 0.635. The example was otherwise identical with Example 1 except that the heated tube was absent, i.e. only a heated shroud was present. Yarns were wound up at speeds of 4000, 5000 and 6000 meters/minute with the following properties:

| WIND-UP SPEED M/MIN | TENACITY (T) G/DTEX | EXT (E) % | $TE^{\frac{1}{2}}$ |
|---|---|---|---|
| 4000 | 2.54 | 87.4 | 23.7 |
| 5000 | 3.04 | 58.8 | 23.3 |
| 6000 | 3.12 | 45.3 | 20.9 |

Thus, it was not possible to achieve yarn properties similar to those reported in Example 1 merely by employing a heated shroud in the absence of a heated tube.

EXAMPLE 7 (Single-stage prior art process)

Example 1 was repeated except that the 30 cm long heated shroud fitted beneath the spinneret was removed, i.e. only a heated tube was present. Corresponding results were as follows:

| WIND-UP SPEED M/MIN | TENACITY (T) GM/DTEX | EXT (E) % | BOILING WATER SHRINKAGE % | $TE^{\frac{1}{2}}$ |
|---|---|---|---|---|
| 4000 | 3.22 | 45.0 | 4.9 | 21.6 |
| 4500 | 3.39 | 41.4 | 5.1 | 21.8 |
| 5000 | 3.62 | 31.6 | 5.4 | 20.3 |
| 5500 | 3.16 | 48.0 | 6.0 | 21.9 |
| 6000 | 3.13 | 41.6 | 6.5 | 20.2 |
| 6500 | Yarn breaks | | | |

As can be seen yarn properties peak at about 5000 meters/minute and thereafter begin to fall, reverting to properties which are consistant with traditional melt spinning (extrusion) at high speeds (see Example 8) before the yarn breaks at 6500 meters/minute.

EXAMPLE 8 (Single-stage process derived from the prior art)

Example 1 was repeated except that the heated shroud and tube wee replaced by a cross-flow quenching device similar to that used in conventional low speed polyester melt spinning processes (wind up speed about 1000 meters/minute) for the manufacture of low and medium tenacity yarns. The device was 50 cm long and 11 cm wide and provided an air flow normal to the direction of travel of the filaments of 1700 liters/minute at a temperature of 30° C. Yarns wound up at various speeds from 4000 meters/minute had the following properties:

| WIND-UP SPEED M/MIN | TENACITY (T) GMS/DTEX | EXTENSION (E) % | BOILING WATER SHRINKAGE % | $TE^{\frac{1}{2}}$ |
|---|---|---|---|---|
| 4000 | 2.53 | 84 | 47.7 | 23.2 |
| 4500 | 2.71 | 70 | 5.2 | 22.7 |
| 5000 | 2.91 | 55 | 3.8 | 21.6 |
| 5500 | 3.0 | 50 | 3.3 | 21.2 |
| 6000 | 3.02 | 42 | 3.7 | 19.6 |
| 6500 | Yarn breaks | | | |

Thus, it was not possible to achieve yarn properties similar to those reported in Example 1 merely by employing a known cross-flow quench at the higher wind up speeds of the present invention.

I claim:

1. A draw spinning process for the manufacture of polyester filaments comprising directly extruding molten polyester filaments into a first fluid environment heated to a temperature above the melting point of the filaments and subsequently passing said filaments through a second fluid environment heated to a temperature above the glass transition temperature but below the melting temperature of the filaments, said fluid environments being separate from one another a distance sufficient to cool the filaments below the temperature of the second fluid environment, and withdrawing and winding up the filaments at a speed in excess of 5500 meters/minute.

2. A process according to claim 1 in which the fluid environments are separated by between 100 cm and 500 cm.

3. A process according to claim 1 in which the fluid environment is air.

4. A process according to claim 1 in which the filaments are wound up at a speed in excess of 6000 meters/minute.

5. A process according to claim 1 in which the filaments are cooled between the first and second fluid environments.

* * * * *